US005170807A

United States Patent [19]

Kasbo et al.

[11] Patent Number: 5,170,807

[45] Date of Patent: Dec. 15, 1992

[54] METHOD OF PRODUCING A NON-BURNING OUTER WRAPPER FOR USE WITH SMOKING PRODUCTS

[75] Inventors: Loyd G. Kasbo, Norcross; Peter E. Brighenti, Marietta; William F. Cartwright, Roswell; Carmen P. DiGrigoli, Canton; Benji D. Morgan, Atlanta, all of Ga.

[73] Assignee: Kimberly Clark Corporation, Neenah, Wis.

[21] Appl. No.: 736,852

[22] Filed: Jul. 29, 1991

Related U.S. Application Data

[63] Continuation-in-part of Ser. No. 556,581, Jul. 20, 1990, abandoned.

[51] Int. Cl.[5] ..... A24D 1/02

[52] U.S. Cl. ..... 131/365; 162/139

[58] Field of Search ..... 131/365; 162/139

[56] References Cited

U.S. PATENT DOCUMENTS

| | | | |
|---|---|---|---|
| 2,998,012 | 8/1961 | Lamm | 131/15 |
| 4,044,778 | 8/1977 | Cohn | 131/4 A |
| 4,453,553 | 6/1984 | Cohn . | |
| 4,489,738 | 12/1984 | Simon | 131/349 |
| 4,714,082 | 12/1987 | Banerjee et al. . | |
| 4,732,168 | 3/1988 | Resce et al. . | |
| 4,779,631 | 10/1988 | Durocher et al. . | |
| 4,941,485 | 7/1990 | Perfetti et al. | 131/365 |

FOREIGN PATENT DOCUMENTS

| | | |
|---|---|---|
| 0193607 | 10/1986 | European Pat. Off. . |
| 0212234 | 4/1987 | European Pat. Off. . |
| 2,619,994 | 3/1989 | France . |
| 2209268A | 10/1989 | United Kingdom . |
| 2209269A | 10/1989 | United Kingdom . |

*Primary Examiner*—V. Millin
*Assistant Examiner*—J. Doyle
*Attorney, Agent, or Firm*—William D. Herrick

[57] ABSTRACT

There is disclosed a method of producing a non-burning wrapper for use with smoking products. A non-burning wrapper is formed by treating a base paper with a solution consisting essentially of water, calcium chloride and a reactive size for paper; drying the thus treated paper; coating one side of the thus treated base paper with a solution consisting essentially of water, calcium carbonate, potassium silicate and sodium carboxymethycellulose; and drying the thus treated and coated paper to form a non-burning wrapper for use with smoking products.

18 Claims, No Drawings

METHOD OF PRODUCING A NON-BURNING OUTER WRAPPER FOR USE WITH SMOKING PRODUCTS

This application is a continuation-in-part of copending U.S. patent application Ser. No. 556,581 filed Jul. 20, 1990 now abandoned.

FIELD OF INVENTION

The invention relates to a method for producing a non-burning wrapper for use with smoking products. More specifically, this invention relates to a method for producing a non-burning cigarette wrapper using a treating solution containing calcium chloride, a reactive size for paper, and a coating solution containing calcium carbonate, potassium silicate and sodium carboxymethylcellulose.

BACKGROUND OF THE INVENTION

One of the more recent developments in the field of cigarette technology involves cigarettes which contain a non-tobacco fuel source which typically heats tobacco contained within a cigarette.

One problem encountered in producing such cigarettes is the availability of a suitable wrapper. The burning of tobacco in conventional cigarettes masks the odor of the burning wrapper used in conventional cigarettes. Because non-tobacco fueled cigarettes have little or no odor attributable to the combustion of the fuel element or tobacco, any odor resulting from the burning of the wrapper is highly noticeable. A suitable wrapper must, therefore, emit little if any aroma or smoke upon ignition of the cigarette, have the appearance of a conventional cigarette and provide adequate support once the cigarette is lit to contain the fuel source within the cigarette.

It is known in the art to add burn control agents to paper used with smoking products to control burn rate, ash formation and sidestream smoke emission. These agents may act to either retard or accelerate the burn rate of the paper. However, even though burn rate is controlled, paper treated with such burn control agents generally burns unless large amounts of burn control agents are added. This burning produces an unpleasant odor and transforms the cellulose into a non-cellulose ash. Alternatively, paper treated with large amounts of burn control agents is transformed by the heat into a cellulose char, and the emission of appreciable odor and smoke is eliminated. However, the char produced is typically a black or an aesthetically unacceptable dark color.

U.S. Pat. No. 4,453,553, teaches a wrapper treated with a burn retarding compound which produces a light grey or white ash. This wrapper is not acceptable because it burns emitting an odor and forming an ash which does not possess sufficient strength to contain the fuel source within the cigarette.

Another example is disclosed in U.S. Pat. No. 4,779,631. This wrapper, has the disadvantage of providing a non-uniform length of ash, the length of which varies with the puffing strength of the smoker, produces an aroma which is irritating and detrimental to room aroma, and does not provide uniform delivery to the smoker.

Thus, a need exists in the art for a wrapper for use with smoking products which does not produce a noticeable aroma, does not burn out to form an ash incapable of containing the fuel source, and does not produce a variable length char or char having an aesthetically unacceptable color, and which provides uniform delivery to the smoker.

SUMMARY OF THE INVENTION

The present invention solves the above-described need by providing a method of producing a non-burning cigarette wrapper which does not impart a significant aroma, forms a white or gray char capable of containing the fuel source, provides uniform delivery to the smoker and is less sensitive to differences in heat generated by the fuel source.

Generally described, the method of this invention comprises the steps of forming a treating solution consisting essentially of water, calcium chloride and a reactive size for paper; treating both sides of a base paper with the treating solution; drying the thus treated paper; forming a coating solution consisting essentially of water, calcium carbonate, potassium silicate, and sodium carboxymethylcellulose; coating one side of the thus treated paper with the coating solution; and drying the thus treated and coated paper to form a non-burning wrapper for use with smoking products.

The preferred method of this invention comprises the steps of forming an aqueous treating solution having between 9% and 18% by weight calcium chloride solids and between 0.2% and 2.0% by weight reactive size; treating both sides of a base paper having an untreated permeability of between 200 and 6500 cm/min (determined in accordance with the CORESTA permeability determination method) with the treating solution such that the base paper contains calcium chloride in an amount between 6% and 14% by weight of the treated paper and reactive size for paper in an amount between 0.1% and 1.5% by weight of the treated paper; forming an aqueous coating solution having between 2% and 8% by weight calcium carbonate solids, between 1% and 5% by weight potassium silicate solids, and between 0.3% and 2.5% by weight sodium carboxymethylcellulose solids; coating one side of the thus treated paper with the coating solution such that the paper contains calcium carbonate in an amount between 3% and 10% by weight of the finished wrapper, potassium silicate in an amount between 2% and 6% by weight of the finished wrapper and sodium carboxymethylcellulose in an amount between 0.3% and 1.5% by weight of the finished wrapper and drying the thus treated and coated paper to form a finished non-burning wrapper for use with smoking products.

Accordingly, an object of the invention is to provide a method for producing a non-burning wrapper for use with smoking products.

A further object is to provide a non-burning wrapper for use with cigarettes which contain a non-tobacco fuel source.

Yet another object of the invention is to provide a non-burning wrapper for cigarettes which does not impart a significant aroma, forms a white or grey char capable of containing the fuel source, provides uniform delivery to the smoker, and is not sensitive to differences in heat generated by the fuel source.

DETAILED DESCRIPTION OF THE PREFERRED EMBODIMENT

In a preferred embodiment, the method of this invention comprises the following steps. First, an aqueous treating solution is formed having between 9% and 18% by weight calcium chloride solids and between 0.2% and 2.0% by weight reactive size, preferably "Hercon 70" available from Hercules, Inc. of Wilmington, Del.; next, using conventional saturation methods, such as a size press, the treating solution is applied to both sides of a base paper, the base paper preferably being 100% cellulose paper and having a permeability between 200 and 6500 cm/min as determined in accordance with the CORESTA permeability determination method. The thus treated paper is then dried using a standard drying method. Using this solution and a standard saturation method, a treated paper containing calcium chloride in an amount between 6% and 14% by weight of the treated paper and reactive size in an amount between 0.1% and 1.5% by weight of the treated paper is formed. These percentages may be determined by wet pick-up or by any standard method for detecting chloride or calcium ions. It is necessary that a homogeneous treating solution is formed, since application of the calcium chloride to the base paper prior to application of the reactive size adversely affects the subsequent step by allowing the reactive size to form a barrier between the calcium chloride and the potassium silicate added in the next step.

Continuing with the process, an aqueous coating solution is formed having between 2% and 8% by weight calcium carbonate, preferably "Albacar 5970," available from Pfizer & Co., Inc. of New York, N.Y.; between 1% and 5% by weight potassium silicate solids, preferably "Kasil #1" available from Philadelphia Quartz Co. of Philadelphia, Pa.; and between 0.3% and 2.5% by weight sodium carboxymethylcellulose solids, an example being "7H3SF" available from Aqualon, a division of Hercules, Inc. Using a standard coater with a Mayer rod setup, the coating solution is applied to one side of the above treated base paper. Using this solution and application method, a finished wrapper containing calcium carbonate in an amount between 3% and 10% by weight of the finished wrapper, potassium silicate in an amount between 2% and 6% by weight of the finished wrapper, and sodium carboxymethylcellulose in an amount between 0.3% and 1.5% by weight of the finished wrapper is obtained.

In preparing the coating solution, the following procedure is believed to produce the best results:

(1) Thoroughly mix the water and the calcium carbonate such that the calcium carbonate is fully dispersed before adding the potassium silicate;
(2) Add the potassium silicate and mix thoroughly;
(3) Add the sodium carboxymethylcellulose and mix thoroughly. If sodium carboxymethylcellulose is added directly to the calcium carbonate, dispersion will be inhibited.

The final step in making a non-burning paper for use with cigarettes is to dry the thus treated and coated treated paper.

Additionally, while the preferred embodiment discloses the use of calcium carbonate, other fillers such as titanium dioxide and magnesium dioxide may be utilized.

The method of this invention provides a novel cigarette wrapper which does not burn so as to form an ash, but chars, such that it still contains cellulose, to an aesthetically pleasing gray color resembling conventional cigarette ash. The cigarette wrapper does not emit noxious or unpleasant odors when lit and provides a char strong enough to hold the fuel source of the cigarette in place.

Another feature of the present invention is the variable permeability of the wrapper. To provide a cigarette which is easily lit, it is important to provide a low permeability wrapper so that during lighting most of the air is pulled through the end of the cigarette at the fuel source. Once the cigarette is lit, however, it is preferable to have paper of higher permeability so that more air is drawn through the wrapper to provide adequate air delivery with each puff. The wrapper of the present invention provides this versatility by having a coating which reduces the permeability of the paper from between 30% to 80% for lighting the cigarette. Once the char is formed the coating degrades to provide a char area having approximately the same permeability as the original uncoated wrapper.

EXAMPLE I

A base sheet (33 gsm) of paper, with a permeability of 2700 cm/min (CORESTA), made by known conventional papermaking techniques, was treated with an aqueous solution of calcium chloride to obtain a paper sheet containing 8 percent calcium chloride by weight. The dried paper was then coated in the following manner. An aqueous coating formulation was prepared using the previously described procedure which contains 5.3% calcium carbonate (chalk), 5.3% potassium silicate and 0.5% sodium carboxymethylcellulose. The aqueous coating was mixed thoroughly and then applied to one side of the calcium chloride containing sheet using a Mayer rod technique. With the use of different volume Mayer rods, the coating weight can be varied. This has a small effect on the final permeability of the finished sheet. The results are shown below.

| Finished Sheet Basis Weight gsm | Dried Coating Weight gsm | CORESTA Permeability cm/min |
|---|---|---|
| 41.0 | 5.2 | 386 |
| 42.5 | 6.6 | 315 |
| 43.5 | 7.5 | 245 |

The other coated papers are made in a similar manner starting with base sheets of the desired permeability, such as 6500, 4500, 500 CORESTA units.

An example of the effect of the coating on permeability for other such sheets of varying basis weight and 5.5 gsm dried coating weight is set forth below:

| Base Sheet Permeability cm/min | Coated Sheet Permeability cm/min |
|---|---|
| 6500 | 1670 |
| 4500 | 1120 |
| 2700 | 364 |
| 500 | 190 |

The foregoing description relates to certain embodiments of the present invention, and modifications or alterations may be made without departing from the spirit and scope of the invention as defined in the following claims.

We claim:

1. A method of producing a non-burning wrapper for use with smoking products, comprising the steps of:

forming a treating solution consisting essentially of: water, calcium chloride and a reactive size for paper;

treating both sides of a base paper with said treating solution to form a treated paper;

drying the thus treated paper;

forming a coating solution consisting essentially of water, calcium carbonate, potassium silicate, and sodium carboxymethylcellulose;

coating one side of the thus treated paper with said coating solution to form a treated and coated paper; and drying the treated and coated paper to form a non-burning wrapper for use with smoking products.

2. The method of claim 1, wherein said base paper has a permeability between 200 cm/min. and 6500 cm/min as determined by the CORESTA permeability determination method.

3. The method of claim 2, wherein said base paper is 100% cellulose.

4. A non-burning wrapper for use with smoking products made in accordance with the method of claim 3.

5. A non-burning wrapper for use with smoking products made in accordance with the method of claim 2.

6. The method of claim 1, wherein said treating solution contains calcium chloride solids in an amount between 9% and 18% by weight and reactive size in an amount between 0.2% and 2.0% by weight.

7. A non-burning wrapper for use with smoking products made in accordance with the method of claim 6.

8. The method of claim 1, wherein said non-burning wrapper contains calcium chloride in an amount between 6% and 14% by weight of the treated paper and reactive size in an amount between 0.1% and 1.5% by weight of the treated paper.

9. A non-burning wrapper for use with smoking products made in accordance with the method of claim 8.

10. The method of claim 1, wherein said coating solution contains calcium carbonate solids in an amount between 2% and 8% by weight, potassium silicate solids in an amount between 1% and 5% by weight, and sodium carboxymethylcellulose in an amount between 0.3% and 2.5% by weight.

11. The method of claim 10, wherein said coating solution is prepared by first mixing the water and calcium carbonate, then mixing in the potassium silicate, and then mixing in the sodium carboxymethylcellulose.

12. A non-burning wrapper for use with smoking products made in accordance with the method of claim 11.

13. A non-burning wrapper for use with smoking products made in accordance with the method of claim 10.

14. The method of claim 1, wherein said non-burning wrapper contains calcium carbonate in an amount between 3% and 10% by weight of the wrapper, potassium silicate in an amount between 2% and 6% by weight of the wrapper, and sodium carboxymethylcelulose in an amount between 0.3% and 1.5% by weight of the wrapper.

15. A non-burning wrapper for use with smoking products made in accordance with the method of claim 14.

16. A non-burning wrapper for use with smoking products made in accordance with the method of claim 1.

17. A method of producing a non-burning wrapper for use with smoking products, comprising the steps of:

forming a treating solution consisting essentially of between 80.0% and 90.8% by weight water, between 9% and 18% by weight calcium chloride solids, and between 0.2% and 2.0% by weight reactive size;

treating both sides of a base paper having a permeability of between 200 and 6500 cm/min, as determined by the CORESTA method of permeability determination, with the treating solution to form a treated paper containing calcium chloride in an amount between 6% and 14% by weight of the treated paper and reactive size in an amount between 0.1% and 1.5% by weight of the treated paper;

drying the thus treated paper;

forming a coating solution consisting essentially of between 84.5% and 96.7% by weight water, between 2% and 8% by weight calcium carbonate solids, and between 1% and 5% by weight potassium silicate solids, and between 0.3% and 2.5% by weight sodium carboxymethyl cellulose solids.

coating one side of the treated paper with the coating solution such that the non-burning wrapper contains calcium carbonate in an amount between 3% and 10% by weight of the non-burning wrapper, potassium silicate in an amount between 2% and 6% by weight of the non-burning wrapper, and sodium carboxymethylcellulose in an amount between 0.3% and 1.5% by weight of the non-burning wrapper after being coated with the coating solution; and drying the thus treated and coated paper to form the non-burning wrapper for use with smoking products.

18. A non-burning wrapper for use with smoking products, comprising:

a base paper having a first side and a second side;

a treating layer on each of the first and second sides, said treating layer consisting essentially of calcium chloride in an amount between 6% and 14% by weight of the thus treated paper and reactive size for paper in an amount between 0.1% and 1.5% by weight of the thus treated paper; and a coating layer on top of one of the treating layers, said coating layer consisting essentially of calcium carbonate in an amount between 3% and 10% by weight of the non-burning wrapper, potassium silicate in an amount between 2% and 6% by weight of the non-burning wrapper, and sodium carboxymethyl cellulose in an amount between 0.3% and 1.5% by weight of the non-burning wrapper.

* * * * *